US006167588B1

(12) United States Patent
Dyson

(10) Patent No.: US 6,167,588 B1
(45) Date of Patent: Jan. 2, 2001

(54) VACUUM CLEANER WITH FILTER CLOGGING INDICATING MEANS

(75) Inventor: James Dyson, Wiltshire (GB)

(73) Assignee: Notetry Limited, Wiltshire (GB)

( * ) Notice: Under 35 U.S.C. 154(b), the term of this patent shall be extended for 0 days.

(21) Appl. No.: 09/331,466

(22) PCT Filed: Dec. 17, 1997

(86) PCT No.: PCT/GB97/03462

§ 371 Date: Aug. 2, 1999

§ 102(e) Date: Aug. 2, 1999

(87) PCT Pub. No.: WO98/27857

PCT Pub. Date: Jul. 2, 1998

(30) Foreign Application Priority Data

Dec. 20, 1996 (GB) ..... 9626451

(51) Int. Cl.[7] ..... A47L 9/28
(52) U.S. Cl. ..... 15/339; 15/319
(58) Field of Search ..... 15/319, 339, 347

(56) References Cited

U.S. PATENT DOCUMENTS

| | | | | |
|---|---|---|---|---|
| 3,381,652 | * | 5/1968 | Schaefer et al. | 15/339 |
| 3,587,514 | * | 6/1971 | Autrand | 15/339 |
| 3,984,735 | * | 10/1976 | Schwartz | 15/339 |
| 4,294,595 | * | 10/1981 | Bowerman | 15/339 |
| 4,733,431 | * | 3/1988 | Martin | 15/339 |
| 5,141,309 | | 8/1992 | Wörwag | 356/72 |
| 5,722,109 | * | 3/1998 | Delmas et al. | 15/339 |

FOREIGN PATENT DOCUMENTS

| | | | | |
|---|---|---|---|---|
| 27 26 467 | | 12/1978 | (DE) . | |
| 4025482 | * | 3/1991 | (DE) | 15/339 |
| 0 366 295 | | 5/1990 | (EP) . | |
| 479126 | | 7/1938 | (GB) . | |
| 1 489 316 | | 10/1977 | (GB) . | |
| 1 574 165 | | 9/1980 | (GB) . | |
| 2 110 923 | | 7/1983 | (GB) . | |
| 2 311 023 | | 9/1997 | (GB) . | |
| 94/00046 | * | 1/1994 | (WO) . | |
| 98/02080 | * | 1/1998 | (WO) . | |

* cited by examiner

*Primary Examiner*—Robert J. Warden, Sr.
*Assistant Examiner*—Theresa T. Snider
(74) *Attorney, Agent, or Firm*—Morrison & Foerster LLP

(57) ABSTRACT

The invention provides a vacuum cleaner having an airflow path, dust separating apparatus (16) arranged in the airflow path and a motor (24) arranged in the airflow path downstream of the dust separating apparatus (16), a pre-motor filter (20) located immediately upstream of the motor (24) and downstream and separate from the dust separating apparatus (16), and a bleed valve (18) located upstream of the pre-motor filter (20) to allow air to be bled into the airflow path in the event of a blockage occurring upstream of the bleed valve (18), wherein signalling means (30, 32, 34) responsive to a change in an operating condition of the motor (24) are provided to indicate that a blockage has occurred at or downstream of the pre-motor filter (20).

16 Claims, 2 Drawing Sheets

VACUUM CLEANER WITH FILTER CLOGGING INDICATING MEANS

FIELD OF THE INVENTION

Figure 1:
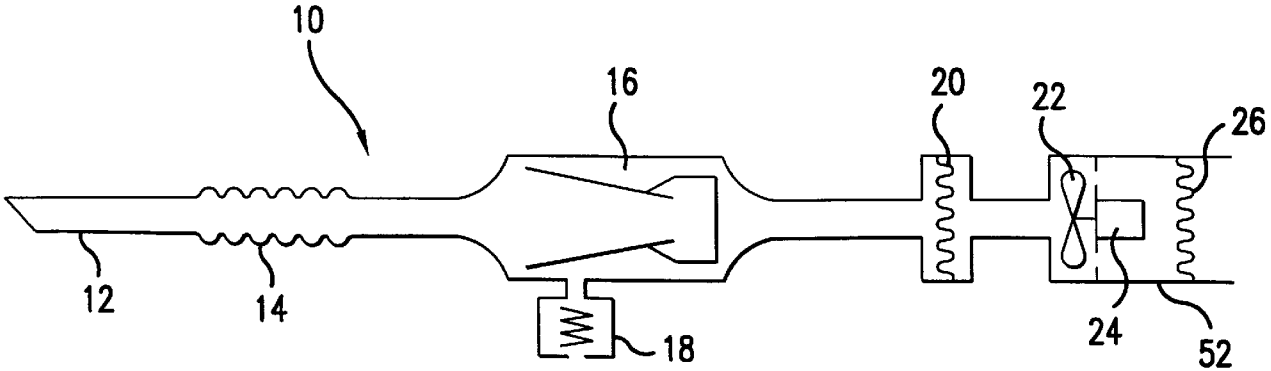
FIG. 1 PRIOR ART

The invention relates to vacuum cleaners. Particularly, but not exclusively, the invention relates to domestic vacuum cleaners.

BACKGROUND OF THE INVENTION

A domestic vacuum cleaner normally consists of an airflow path having a dirty air inlet at one end and a clean air outlet at the other end. Arranged in the airflow path, normally at or near the clean air outlet, is a fan driven by a motor which draws dirt-laden air into the dirty air inlet. The airflow then passes through dirt and dust separating apparatus to remove dirt and dust particles from the airflow and past the fan and motor before exiting to the atmosphere via the clean air outlet. The passage of the airflow past the motor cools the motor during operation.

Very many vacuum cleaners incorporate filters designed to protect the motor. These filters can be arranged upstream or downstream of the motor. Occasionally, filters are arranged both upstream and downstream of the motor. These filters are in addition to the main dirt and dust separating apparatus of the vacuum cleaner. The dirt and dust separating apparatus will normally consist of either a bag or a cyclonic separator as in U.S. Pat. Nos. 4,571,772; 4,593,429; 4,643,748; 4,826,515; 4,853,008; 4,853,011; 5,062,870; 5,078,761; 5,090,976; 5,145,499 and 5,160,356. Some vacuum cleaners incorporate bleed valves which allow additional air to be bled into the airflow path in the event of a blockage occurring in the airflow path as in WO 94/00046 and WO 98/02080, the disclosure of which is incorporated by reference herein. In some cases, this can help to prevent the motor overheating due to insufficient cooling. However, the filters arranged close to the motor, particularly the pre-motor filter, can also become clogged after extensive use. What very often happens is that the motor includes a thermo-trip which cuts off the motor if it begins to overheat due to insufficient cooling. The user is forced to stop using the cleaner until the motor has cooled down. However, in many cases, the user merely recommences cleaning as soon as possible without addressing the problem of why the motor is overheating. This is because the user is unaware of the specific cause of the motor overheating. Repeated overheating and cut-out of the motor is frustrating to the user. An indication of the cause of the overheating so that the user can address the problem would alleviate some of that frustration.

Provision of an indication to the user of the clogged condition of a dirt-collecting bag is known from U.S. Pat. No. 3,936,904.

Indication to the user that a postmotor filter may require changing is disclosed by DE-A-3712233.

It is an object of the present invention to provide a vacuum cleaner which is easy to operate and which provides an indication to the user that specific action is required to overcome a problem. It is a further object of the present invention to provide a vacuum cleaner which provides an indication to the user that the pre-motor filter is blocked.

SUMMARY OF THE INVENTION

The invention provides a vacuum cleaner as set out in claim 1. Advantageous features are set out in the subsidiary claims.

The advantage of the invention is that a signal, which warns the user that some action is required, is given when the motor overheats or is likely to overheat due to the pre-motor filter becoming blocked. Blockages upstream of the bleed valve cause air to be bled into the airflow path to maintain sufficient airflow past the motor to prevent overheating. Therefore, the signal is only given when the cause of overheating is different from a blockage occurring upstream of the bleed valve. The signal can be audible or visual, preferably in the form of an illuminated sign or light which is intended to inform the user that the filter or filters located adjacent the motor require to be changed. The signalling means can be made responsive to the actual motor temperature, the ambient temperature within the motor housing or a vacuum pressure change. All three of these characteristics or operating conditions are indicative of a situation in which the motor is likely to overheat.

By providing a warning signal, the user is encouraged to change the filter or filters arranged near the motor. Changing the filter or filters is highly likely to remove the reason for the motor overheating and cutting out. This results in improved performance of the vacuum cleaner and enhanced customer satisfaction.

Figure 1A:
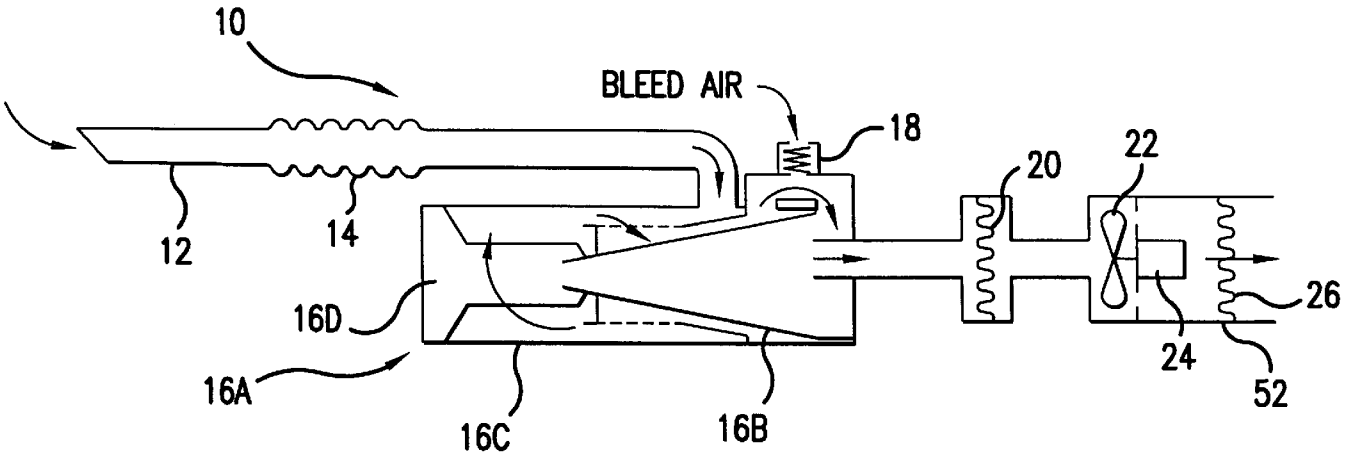
FIG. 1A PRIOR ART
Figure 2A:
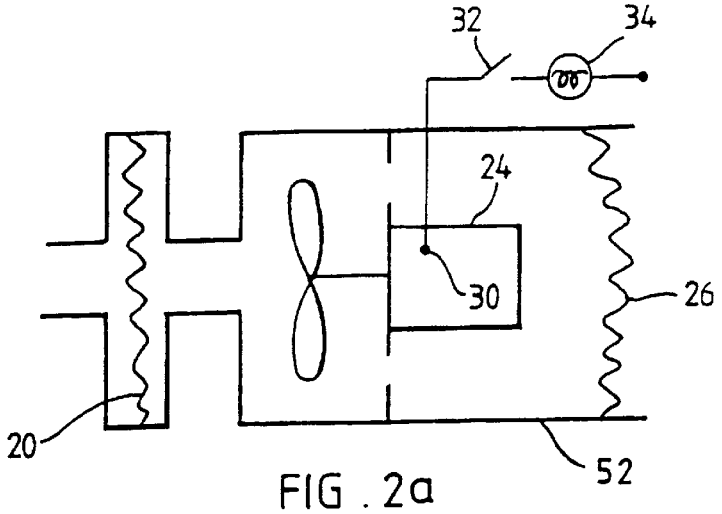
Figure 2B:
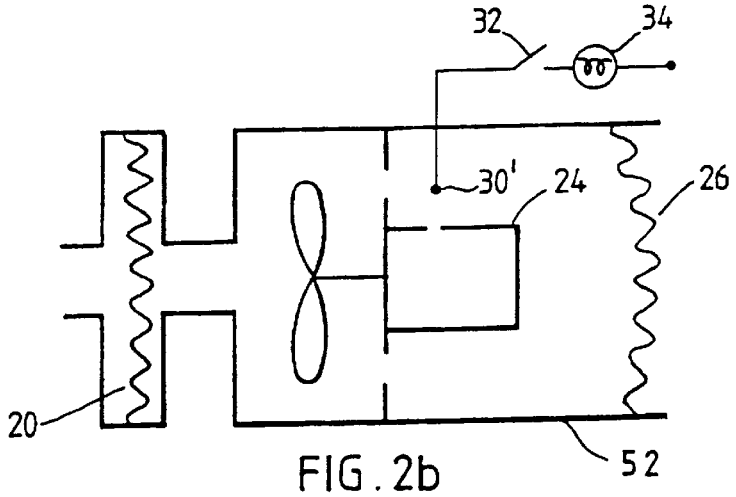

Embodiments of the invention will now be described, by way of example only, with reference to the accompanying drawings wherein:

FIG. 1 is a schematic illustration of a vacuum cleaner according to the prior art;

FIG. 1*a* is a more detailed schematic illustration of the cleaner of FIG. 1;

FIG. 2*a* illustrates, in schematic form, a modification of the apparatus shown in FIG. 1 according to the invention;

FIG. 2*b* illustrates a second alternative modification; and

Figure 2C:
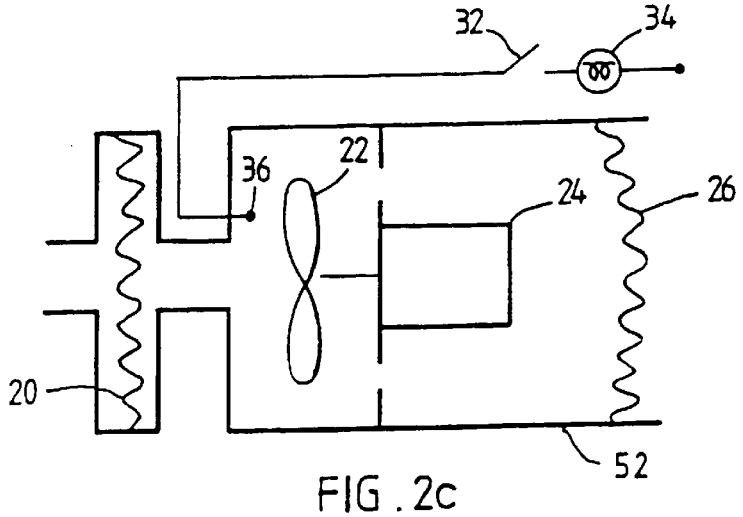

FIG. 2*c* illustrates a third alternative modification.

DETAILED DESCRIPTION OF THE INVENTION

FIGS. 1 and 1*a* are schematic illustrations of a known vacuum cleaner of the type shown in WO 94/00046. The vacuum cleaner 10 incorporates a nozzle 12 attached directly to a hose 14 and the hose 14 is directly connected to dust-separating apparatus 16. The dust-separating apparatus 16 can be any conventional dust-separating apparatus but in this case comprises cyclonic separating apparatus consisting of two cyclones 16A, including outer cyclone 16C, inner cyclone 16B and receiving chamber 16D arranged in series. The arrangement, dimensions and operation of such dust-separating apparatus 16 are well documented elsewhere and will not be described any further here, other than to mention that a bleed valve 18 is located in the airflow path between the two cyclones 16B, 16C as shown in FIG. 1*a*. Downstream of the dust-separating apparatus 16 is a pre-motor filter 20, followed by a fan 22, a motor 24 and a post-motor filter 26, seen in the direction of airflow.

In use, the motor 24 operates to activate the fan 22 which causes a flow of air to pass from the nozzle 12 to the dust-separating apparatus 16 via the hose 14. After separation has taken place, the airflow passes through the pre-motor filter 20, past the fan 22, past the motor 24 providing a cooling effect, and through the post-motor filter 26 before being expelled to the atmosphere. The bleed valve 18 is arranged such that, if the pressure within the dust-separating apparatus 16, and particularly at the location within the dust-separating apparatus 16 at which the bleed valve 18 is placed, drops below a pre-determined value, the bleed valve 18 opens so as to allow air from the atmosphere to enter the cyclonic dust-separating apparatus in order to maintain an adequate airflow to effect separation. The prevention of the airflow from falling below a predetermined level helps to ensure that the motor 24 is adequately cooled so as to prevent any risk of overheating in the event of a blockage occurring in the airflow path upstream of the bleed valve 18.

The bleed valve 18 shown in FIG. 1 is not effective if, for example, the pre-motor filter 20 becomes clogged. Insufficient suction will be developed in the area of the bleed valve 18 to introduce atmospheric air into the airflow path. A blocked pre-motor filter 20 will effectively prevent sufficient air from passing across the motor 24 to provide adequate cooling. The same is true if the post-motor filter 26 becomes blocked. If the motor 24 begins to overheat, a thermo-trip switch (not shown), which is a standard component in many motors designed for use in vacuum cleaners, will cut off the motor 24. The motor 24 will stop operating and the user of the cleaner will be forced to interrupt use of the machine. However, when the motor 24 has cooled sufficiently, there will be nothing to prevent the user from switching the vacuum cleaner 10 on again and recommencing cleaning operations. Cleaning will continue until the motor 24 again overheats due to the clogged nature of the pre-motor filter 20. The same thing will happen if the post-motor filter 26 is clogged.

In accordance with the invention, and as illustrated schematically in FIGS. 2*a*, 2*b* and 2*c*, a signalling device is provided which gives a warning signal that either or both of the pre-motor filter 20 and post-motor filter 26 requires changing. In FIG. 2*a*, the arrangement is such that a temperature sensor 30 is provided directly on the motor 24 which is located in the airflow path. The temperature sensor 30 is connected to a switch 32 which, when closed, illuminates a lamp or warning sign 34. Thus, when the temperature of the motor 24 is detected by the temperature sensor 30 to have risen to or exceeded a predetermined temperature, the switch 32 will close thus illuminating the warning light 34. The arrangement can be such that the warning light 34 comes on before the motor 24 is cut off by the thermo-trip switch, or so that it comes on simultaneously with the motor 24 being cut off.

The arrangement shown in FIG. 2*b* is such that the temperature sensor is 30' is located in the housing 52 of the motor 24 within the airflow path close to the motor 24 but is not attached directly to the motor 24. The temperature sensor 30' therefore senses the ambient temperature in the housing 52 within the area of the airflow path which houses the motor 24 and is responsive to an increase in that temperature by closing the switch 32 at a predetermined temperature.

A third alternative is shown in FIG. 2*c*. In this case, the signalling device includes a pressure sensor 36 arranged in the airflow path immediately upstream of the fan 22. The pressure sensor 36 is designed to close the switch 32 if the vacuum pressure or suction pressure exceeds a predetermined value due to a blocked filter being present. If this happens, the illuminated sign 34 is switched on. The pressure sensor 36 can be located at any point in the airflow path downstream of the pre-motor filter 20.

Any of these three embodiments of the invention could be modified in one of a number of ways. Firstly, the illuminated lamp or signal could be replaced by an audible signal consisting of an intermittent bleep, a continuous buzz, whistle or bell, or a synthesised or recorded voice message. If a visual signal is used, this could take the form of an illuminated display, a continuously lit lamp or a flashing light. A message stating that either or both of the pre-motor filter and the post-motor filter need cleaning or replacing can be illuminated. It will also be appreciated that the switch 32 could be closed purely in response to the operation of the thermo-trip switch built into the motor.

Either or both of the sensors 30,36 described with reference to FIGS. 2*a* and 2*b* above could be replaced by mechanically operated sensing means such as, for example, temperature sensitive springs, bimetallic strips, etc. Mechanical means such as a pressure sensitive spring or switch could be used in the embodiment illustrated in FIG. 2*c*. The precise means of actuating the signalling means is not essential to the invention. Resetting means can also be provided in the form of a reset button (not shown) which can be operated once the cause of actuation of the signalling means has been removed.

It is preferred that, if visual signalling means are utilised, they be positioned in the immediate vicinity of the on/off switch of the vacuum cleaner. The reason for this is that, after the thermo-trip switch has caused the motor to cut out, the user will see the warning signal as soon as an attempt is made to switch on the vacuum cleaner again. This will encourage the user to check or replace the pre-motor and post-motor filters 20,26 which, in very many cases, will remove the cause of the motor 24 cutting out in the first place.

This invention is applicable to all types of vacuum cleaner, including those which make use of filter bags to remove dirt and dust from the airflow. It is also applicable to upright and cylinder cleaners and it will be appreciated that the schematic illustration shown in FIG. 1 can be adapted so as to replace the nozzle 12 and hose 14 by a floor-engaging cleaning head of the type normally included in upright vacuum cleaners.

What is claimed is:

1. A vacuum cleaner comprising dust separating apparatus arranged in an airflow path, a motor arranged in the airflow path downstream of the dust separating apparatus, a pre-motor filter located upstream of the motor and downstream of and separate from the dust separating apparatus, a bleed valve located upstream of the pre-motor filter to allow air to be bled into the airflow path in the event of a blockage occurring upstream of the bleed valve, a sensor which senses a temperature or pressure in the airflow path at or near the motor and a signaling device responsive to a change in the temperature or pressure sensed by the sensor which indicates a blockage of the pre-motor filter.

2. A vacuum cleaner as claimed in claim 1, wherein the sensor is a temperature sensor.

3. A vacuum cleaner as claimed in claim 2, wherein the signalling device is connected to a switch and provides a signal when the operating temperature of the motor exceeds a predetermined temperature.

4. A vacuum cleaner as claimed in claim 2 wherein the motor comprises a thermo-trip switch and the signalling device is connected to the thermo-trip switch.

5. A vacuum cleaner as claimed in claim 1, wherein the motor is arranged in a motor housing and the sensor is capable of sensing the ambient temperature within the motor housing.

6. A vacuum cleaner as claimed in claim 5, wherein the signalling device is connected to a switch and provides a signal when the ambient temperature within the motor housing exceeds a predetermined temperature.

7. A vacuum cleaner as claimed in claim 1, wherein the sensor is a pressure sensor which senses the vacuum pressure of airflow passing the motor.

8. A vacuum cleaner as claimed in claim 7, wherein the signalling device is connected to a switch and provides a signal when the vacuum pressure of the airflow exceeds a predetermined pressure.

9. A vacuum cleaner as claimed in claim 1, wherein the signalling device is visual.

10. A vacuum cleaner as claimed in claim 9, wherein the signalling device comprises a signal light or illuminated sign.

11. A vacuum cleaner as claimed in claim 9 or 10, wherein the signalling device is provided adjacent or in the vicinity of means for switching the motor of the vacuum cleaner on and off.

12. A vacuum cleaner as claimed in claim 1, wherein the signalling device is audible.

13. A vacuum cleaner as claimed in claim 1, wherein the signaling device provides a signal which indicates that the pre-motor filter may require to be changed.

14. A vacuum cleaner as claim in claim 1 wherein a post-motor filter is also provided, the post-motor filter being located downstream of the motor.

15. A vacuum cleaner as claimed in claim 1 wherein the motor is connected to operate irrespective of whether or not the signalling device is operated.

16. A vacuum cleaner as claimed in claim 1 wherein the dust separating apparatus comprise a cyclonic separator.

* * * * *